US005819680A

United States Patent [19]

Haller et al.

[11] Patent Number: 5,819,680

[45] Date of Patent: Oct. 13, 1998

[54] STEERABLE TOWCRAFT

[75] Inventors: Clayton Forbes Haller, Pleasant Hill; Charles Prior Hall, Santa Rosa, both of Calif.

[73] Assignee: Sterns, Inc., St. Cloud, Minn.

[21] Appl. No.: 788,321

[22] Filed: Jan. 24, 1997

[51] Int. Cl.[6] ..... B63B 21/56

[52] U.S. Cl. ..... 114/253; 441/65

[58] Field of Search ..... 114/253; 441/65, 441/66, 67, 69, 72, 73

[56] References Cited

U.S. PATENT DOCUMENTS

| | | | |
|---|---|---|---|
| 2,568,549 | 9/1951 | Kluttz | 441/65 |
| 2,959,795 | 11/1960 | Kam Fong Leung | 441/73 |
| 3,018,753 | 1/1962 | Price | 441/69 |
| 3,042,944 | 7/1962 | Basey et al. | 114/253 |
| 3,120,011 | 2/1964 | Gunderson | 441/72 |
| 3,148,655 | 9/1964 | Brant | 441/69 |
| 3,434,167 | 3/1969 | Vecchio et al. | 441/67 |
| 3,650,237 | 3/1972 | Hartman | 114/253 |
| 4,552,539 | 11/1985 | Hoenstine et al. | 441/66 |

FOREIGN PATENT DOCUMENTS

| | | | |
|---|---|---|---|
| 4007-645-A | 9/1991 | Germany | 114/253 |

*Primary Examiner*—Sherman Basinger
*Attorney, Agent, or Firm*—Flehr Hohback Test Albritton & Herbert LLP

[57] ABSTRACT

Steerable towcraft having a buoyant body upon which a person can ride, a towline attached to body and adapted for connection to the pulling vessel, a fin on the under side of the body for guiding the body through water, and a steering line connected to the towline at a point spaced from the body. By pulling on the steering line, a person riding on the body can change the angle of the fin relative to the towline, and thereby control the direction in which the towcraft is moving.

11 Claims, 3 Drawing Sheets

STEERABLE TOWCRAFT

BACKGROUND OF THE INVENTION

This invention pertains generally to water sports and, more particularly, to watercraft of the type towed behind a boat or other vessel.

Children and others enjoy being towed behind boats on a variety of buoyant devices such as inner tubes and the like. Such devices are generally attached to the towing vessels by towlines, and there is no way to steer them. They simply go where the boat takes them, and that can become relatively unchallenging and/or uninteresting when the boat is going slowly and in a straight line.

At higher speeds, when the boat makes a turn, centrifugal force can cause the device to swing outside the wake of the boat and to travel substantially farther and faster than the boat itself is travelling. The rider has no control over where or how fast he is going, and in the event of debris or other obstacles in the water, about all the rider can do to protect himself is let go of the line or fall off the device. With a boat travelling at a speed of 25 mph, the tube can travel at speeds as high as 40 to 50 mph, or more, and jumping or falling into the water at those speeds is not something that most people would want to do.

OBJECT AND SUMMARY OF THE INVENTION

It is in general an object of the invention to provide a new and improved towcraft for riding behind boats and other pulling vessels.

Another object of the invention is to provide a towcraft of the above character which overcomes the limitations and disadvantages of the prior art.

Another object of the invention is to provide a towcraft of the above character which can be steered by a person riding thereon.

These and other objects are achieved in accordance with the invention by providing a steerable towcraft which has a buoyant body upon which a person can ride, a towline attached to body and adapted for connection to the pulling vessel, a fin on the under side of the body for guiding the body through water, and a steering line connected to the towline at a point spaced from the body. By pulling on the steering line, a person riding on the body can change the angle of the fin relative to the towline, and thereby control the direction in which the towcraft is moving.

DETAILED DESCRIPTION

Figure 1:
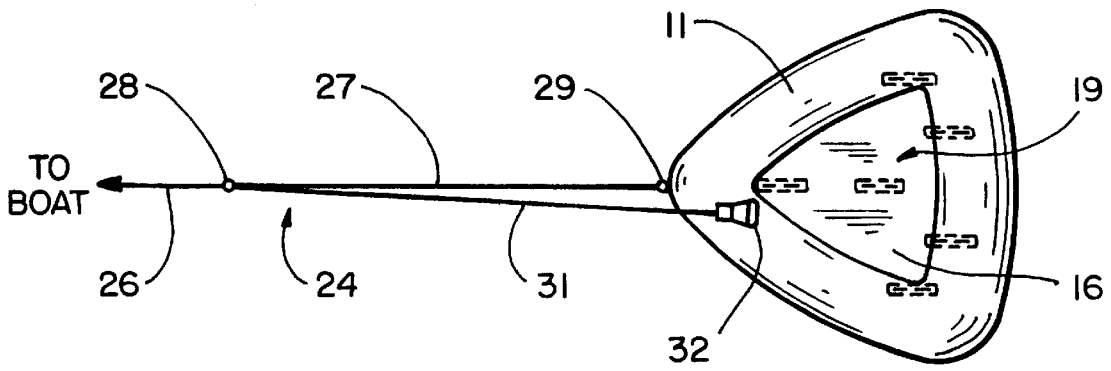
FIG. 1 is a top plan view of one embodiment of a steerable towcraft according to the invention.
Figure 2:
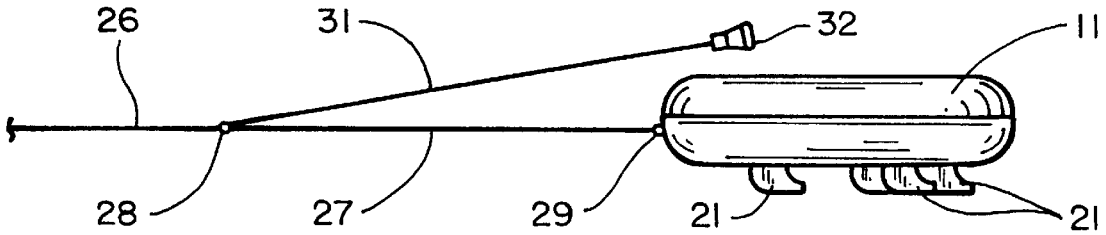
FIG. 2 is a side elevational view of the embodiment of FIG. 1.
Figure 3:
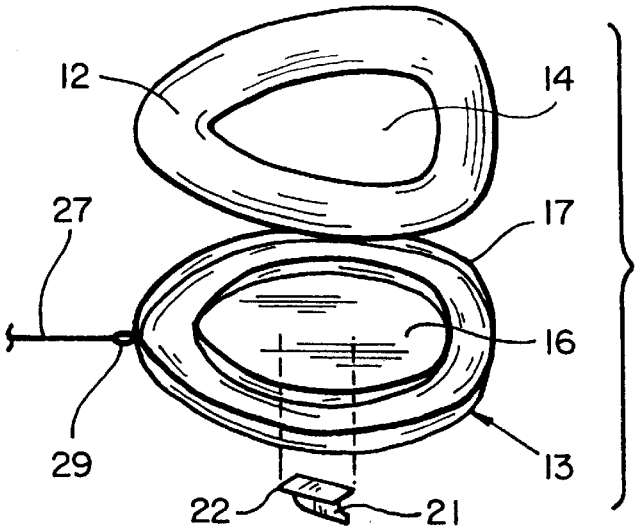
FIG. 3 is a fragmentary exploded view of the embodiment of FIG. 1.

As illustrated in FIGS. 1–3, the towcraft comprises a buoyant body 11 which, in this particular embodiment, consists of a pneumatically inflated tube 12 and a cover or skin 13 which envelopes the tube from below. The tube is fabricated of a material such as vinyl. In plan view, the tube has a generally triangular configuration with rounded corners and a central opening 14. The cover is fabricated of a material such as nylon. It has a bottom wall 16 which extends beneath the tube and a side wall 17 which wraps around the sides and over the top of the tube. The cover is open at the top, and a person riding on the craft sits or kneels in the cavity 19 formed by the opening in the tube and the bottom wall of the cover. The body is assembled by placing the uninflated tube in the cover and inflating it in position.

Fins 21 are provided on the under side of the body for guiding the craft through the water. The number of fins is not critical as long as the fins have sufficient overall area to control the direction of the craft. In the embodiment illustrated, six fins of generally triangular shape are provided. With the tube having an inflated diameter on the order of 12 inches and the body having a length and a width on the order of 4 feet, each of the fins can, for example, have a height on the order of 2½ inches and a length on the order of 6 inches.

The fins are molded of a relatively rigid plastic and have base plates 22 which are affixed to the bottom wall of the cover by suitable means such as sewing. The fins are arranged in a symmetrical pattern, with two of them lying on the longitudinal centerline toward the front of the body and the other four disposed in pairs on opposite sides of the centerline toward the rear of the body.

A towline 24 is attached to the front portion of the body and is adapted for connection to a boat or other pulling vessel (not shown). The towline consists of a long section 26, a short section 27 and a ring 28 between the two sections. The long section is tied or otherwise connected to the boat, and the short section is connected to a ring 29 which is attached to the nylon cover.

The longer section can be of any desired length, and the short section typically has a length on the order of 2 to 7 feet.

A steering line 31 is attached to the towline at ring 28. The steering line is somewhat longer than the shorter section of the towline, and has a handle 32 at its free end which can be grasped by a person riding upon the body. With a towline section having a length of 66 inches, for example, the steering line can have a length on the order of 80 inches.

In use, the front section of the towline is tied or otherwise attached to the boat, and the towcraft is pulled through the water by that line. The person riding on the towcraft holds the handle at the free end of the steering line, and pulls on that line when he wants to make a turn. When travelling straight ahead inside the boat's wake, the steering line can be allowed to slacken since the towline is doing the pulling.

When the rider wants to make a turn, he leans and pulls on the steering line in a direction opposite to the way he wants to go. Thus, to move to the right, the rider leans to the left and pulls on the steering line to the left of the towline. To move to the left, he leans to the right and pulls on the steering line to the right of the towing line.

Since rings 28, 29 are at relatively fixed points in the towline when that line is taut, pulling on the steering line obliquely of the towline causes the body to pivot about ring 29. As the body turns, fins 21 also turn, and the craft moves in the direction in which the body is headed.

Figure 4A:
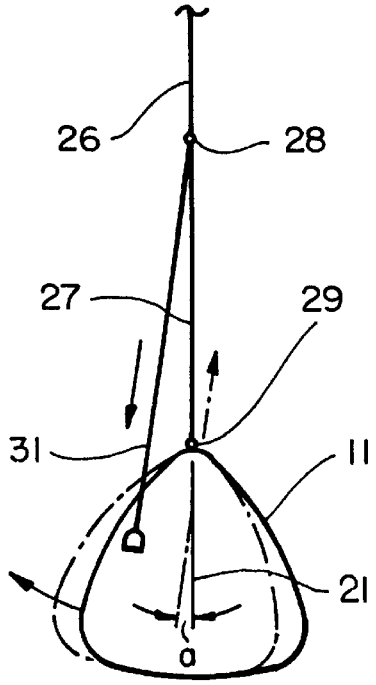
FIGS. 4*a* and 4*b* are diagrammatic views illustrating operation of the embodiment of FIG. 1.
Figure 4B:
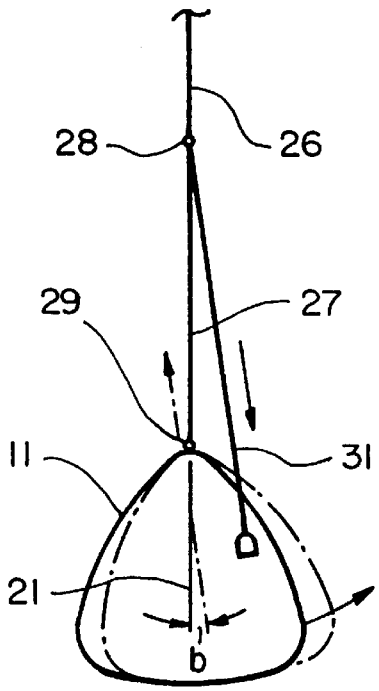

As illustrated in FIG. 4*a*, pulling the steering line to the left causes the rear of towcraft body to swing to the left, changing the orientation of the fins by an angle a and causing the craft to travel to the right. As illustrated in FIG. 4*b*, pulling to the right causes the rear of the craft to swing to the right, changing the orientation of the fins by an angle b and causing the craft to travel to the left.

The angle at which the craft turns is dependent upon the angle of the pull as well as the distance between the front of the craft and the point at which the steering line is connected to the towline, i.e. the distance between rings 28 and 29. As noted above, that distance is generally on the order of 2 to 10 feet, with about 5 providing particularly good steering with a craft of the type and dimensions described above.

Figure 5:
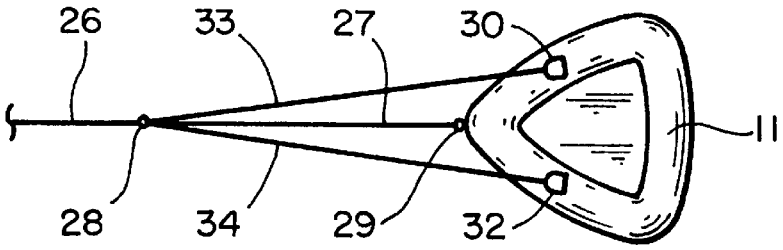
FIGS. 5 and 6 are top plan views of other embodiments of a steerable towcraft according to the invention.

In the embodiment of FIG. 5, a separate steering line 33, 34 is provided for each hand. The front portions of these lines are tied or otherwise affixed to ring 28, and handles 36, 37 are attached to the free ends of the lines. Operation and use of this embodiment is similar to that described above, the only difference being that the rider holds one handle in each hand and pulls upon the line opposite the direction he wants to go. Thus, to travel to the right, he pulls on the line in his left hand, and to travel to the left, he pulls on the line in his right hand.

Figure 6:
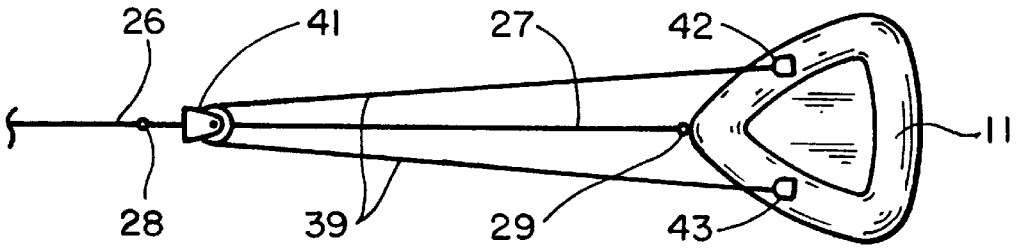

FIG. 6 illustrates an embodiment similar to that of FIG. 5 except the steering line 39 is trained about a pulley 41 attached to ring 28, rather than being affixed directly to the ring. Handles 42, 43 are attached to the two ends of the steering line, and the direction of travel is determined by the net pull exerted on the two ends of the line. Having the line trained about the pulley also gives the rider some additional freedom of positioning and movement since the relative lengths of line in each hand will adjust to accommodate the rider without affecting the steering of the craft.

Figure 7:
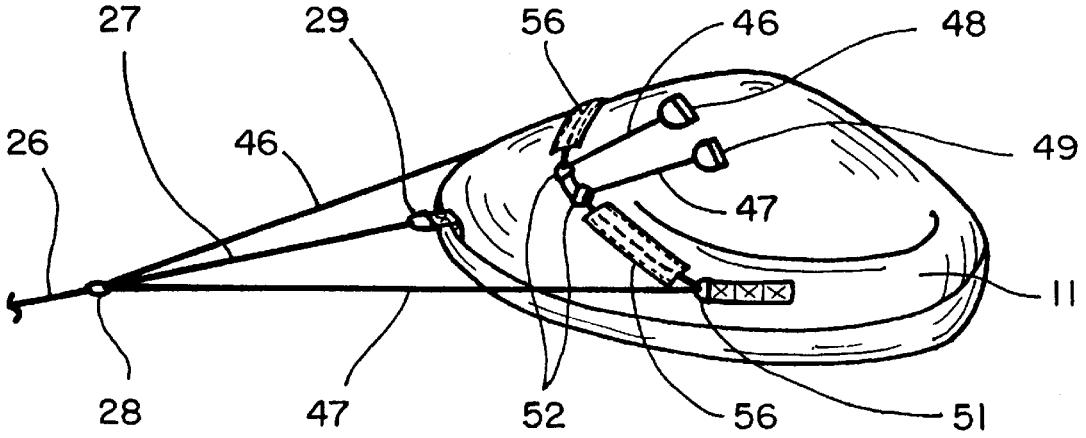
FIGS. 7 and 8 are isometric views of additional embodiments of a steerable towcraft according to the invention.

In the embodiment of FIG. 7, a pair of steering lines 46, 47 with handles 48, 49 are trained about guides 51 which are affixed to the body on opposite sides of the craft. These lines are also trained about a second set of guides 52 which are attached to the body in a more central position. In the embodiment illustrated, the guides consist of D-rings affixed to straps which are sewn to the cover of the body. However, pulleys or other suitable types of guides can be employed, if desired. The portions of the lines between the guides are covered by patches 56 which are sewn to the cover along two opposing edges of the patches to protect the rider from contact with the moving lines.

Operation and use of this embodiment is similar to that of FIG. 5 in that the rider simply pulls on the line on the side opposite the direction he wants to travel, e.g. pulls left to go right. In this embodiment, however, the points at which the pull is applied to the body are fixed by the location of guides 51.

Figure 8:
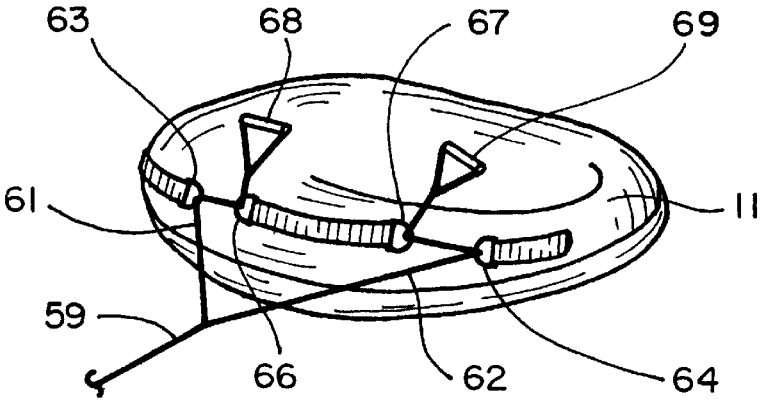

In the embodiment of FIG. 8, a single line 59 is utilized both for towing and for steering. The front portion of this line is attached to the boat, and the rear portion is split into two sections 61, 62 which are trained about guides 63–67. Handles 68, 69 are attached to the free ends of the lines. Guides 63, 64 are affixed to the sides of the body toward the front of the craft, and guides 66, 67 are located closer to the centerline of the craft. The guides are illustrated as being D-rings, but other suitable types of guides, including pulleys, can be employed, if desired.

In operation, the portion of line 59 between the boat and guides 63, 64 serves as the tow line, with the rider holding onto the two handles rather than having the line affixed to the body of the towcraft. To steer, the rider pulls harder on one handle than the other. When he does this, the body of the craft pivots about the guide 63, 64 on the opposite side of the body, and the rear of the craft rotates forward on the side where the greater pull is exerted. As in the other embodiments, the rotation of the body changes the orientation of the fins and causes the craft to move in a direction opposite the side on which the pull is exerted.

Figure 9:
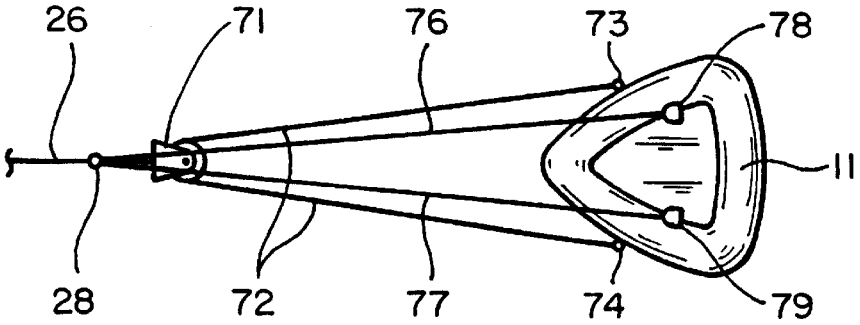
FIG. 9 is a top plan view of another embodiment of a steerable towcraft according to the invention.

In the embodiment of FIG. 9, the towline includes a pulley 71 which is attached to ring 28, and a line bridle 72 which is trained about the pulley and attached to rings 73, 74 on opposite sides of the body. Steering lines 76, 77 are affixed to ring 28, with handles 78, 79 at the ends of the steering lines.

Operation and use of the embodiment of FIG. 9 is similar to that of FIG. 1. However, with line bridle 72 being free to travel about pulley 71, it may be possible to turn the craft at greater angles and to travel farther outside the wake than in the embodiments where the rear section of the towline is affixed to the ring.

The invention has a number of important features and advantages. It permits a person or persons riding on a craft towed by a boat to have complete control over where the craft is going. The rider can simply follow the boat if he wants, he can cut back and forth either inside or outside the wake, and he can steer around debris or other obstacles in the water. Also, if the rider wants to rest, he can simply relax the pull on the steering line(s) and let the craft follow behind the boat.

It is apparent from the foregoing that a new and improved steerable towcraft has been provided. While only certain presently preferred embodiments have been described in detail, as will be apparent to those familiar with the art, certain changes and modifications can be made without departing from the scope of the invention as defined by the following claims.

We claim:

1. A steerable towcraft for use with a pulling vessel, comprising a buoyant body upon which a person can ride, a towline adapted for connection to the pulling vessel, a pulley connected to the towline, a bridle line trained about the pulley and connected to opposite sides of the body, a fin on the under side of the body for guiding the body through water, and a steering line connected to the towline so that a pull on the steering line at an angle to the towline by a person riding on the body causes the body and the fin to turn relative to the towline, thereby changing the direction in which the craft travels through the water with the bridle line being free to travel through the pulley as the direction changes.

2. The steerable towcraft of claim 1 wherein the steering line is connected to the towline at a distance on the order of 2 to 10 feet in front of the body.

3. The steerable towcraft of claim 1 wherein the steering line includes a handle adapted to be grasped by a person riding on the body.

4. The steerable towcraft of claim 1 wherein the steering line includes a pair of handles adapted to be grasped by a person riding on the body.

5. A steerable towcraft for use in water with a pulling vessel, comprising a buoyant body upon which a person can ride, a towline attached to body and adapted for connection to the pulling vessel, a pulley attached to the towline and spaced a fixed distance in front of the buoyant body, a steering line trained about the pulley and extending rearwardly from the pulley toward the buoyant body, and a pair of handles connected to the end portions of the steering line whereby a person riding on the craft can change the direction in which the craft travels through the water by pulling on the handles.

6. The steerable towcraft of claim 1 wherein the body comprises a pneumatically inflated tube and a cover which envelopes the tube, the fin being affixed to the cover on the under side of the tube.

7. A steerable towcraft for use with a pulling vessel, comprising a buoyant body upon which a person can ride, a towline adapted for connection to the pulling vessel, a pulley connected to the towline, a bridle line trained about the pulley and connected to opposite sides of the body, a fin on the under side of the body for guiding the body through water, and a steering line connected to the towline for controlling orientation of the fin relative to the towline with the bridle line being free to shift about the pulley with changes in the orientation.

8. The steerable towcraft of claim 7 wherein the steering line is connected to the towline at a distance on the order of 2 to 10 feet in front of the body.

9. The steerable towcraft of claim 7 wherein the steering line includes a handle adapted to be grasped by a person riding on the body.

10. The steerable towcraft of claim 7 wherein the body comprises a pneumatically inflated tube and a cover which envelopes the tube, the fin being affixed to the cover on the under side of the tube.

11. A steerable towcraft for use with a pulling vessel, comprising a buoyant body upon which a person can ride, a fin on the under side of the body for guiding the body through water, a towline connected to the body and adapted for connection to the pulling vessel, a first pair of guides attached to the body toward opposite sides thereof, a second pair of guides attached to the body near the longitudinal centerline thereof, and a pair of steering lines connected to the towline with each of the steering lines being trained about one of the guides in each pair and end portions of the steering lines extending from the guides and being adapted to be held and pulled upon by a person riding on the body to control the direction in which the craft travels through the water.

* * * * *